US008267146B2

(12) United States Patent
Frede

(10) Patent No.: US 8,267,146 B2
(45) Date of Patent: Sep. 18, 2012

(54) ADJUSTABLE COUNTERBALANCE SYSTEM FOR ROLLER DOORS

(75) Inventor: Friedhelm Frede, Erwitte (DE)

(73) Assignee: Assa Abloy Entrance Systems AB, Landskrona (SE)

( * ) Notice: Subject to any disclaimer, the term of this patent is extended or adjusted under 35 U.S.C. 154(b) by 349 days.

(21) Appl. No.: 12/567,410

(22) Filed: Sep. 25, 2009

(65) Prior Publication Data

US 2011/0073262 A1 Mar. 31, 2011

(51) Int. Cl.

| | |
|---|---|
| ***E05F 13/00*** | (2006.01) |
| ***E05F 15/00*** | (2006.01) |
| ***A47G 5/02*** | (2006.01) |
| ***A47H 3/00*** | (2006.01) |

(52) U.S. Cl. ..... 160/191; 160/190; 160/238

(58) Field of Classification Search ..... 160/189, 160/191, 192, 313

See application file for complete search history.

(56) References Cited

U.S. PATENT DOCUMENTS

| | | | |
|---|---|---|---|
| 520,089 | A | 5/1894 | Spaulding |
| 812,722 | A | 2/1906 | Cahill |
| 3,878,879 | A | 4/1975 | Manns |
| 4,252,172 | A | 2/1981 | Pommat et al. |
| 4,760,622 | A | 8/1988 | Rohrman |
| 4,887,660 | A | 12/1989 | Kraus |
| 4,997,022 | A | 3/1991 | Klein |
| 5,048,588 | A | 9/1991 | Weishar et al. |
| 5,078,197 | A | 1/1992 | Weishar |
| 5,129,442 | A | 7/1992 | Warner |
| 5,141,044 | A | 8/1992 | Hying et al. |
| 5,159,967 | A | 11/1992 | Ashley et al. |
| 5,184,864 | A | 2/1993 | Teigen et al. |
| 5,201,897 | A | 4/1993 | Whiting |
| 5,222,541 | A | 6/1993 | Hornberger |
| 5,299,617 | A | 4/1994 | Hying et al. |
| 5,368,084 | A | 11/1994 | Hying et al. |
| 5,474,117 | A | 12/1995 | Henkenjohann |
| 5,530,991 | A | 7/1996 | deNormand et al. |
| 5,632,317 | A | 5/1997 | Krupke et al. |
| 5,655,591 | A | 8/1997 | Knutson |
| 5,930,865 | A | 8/1999 | Mihalcheon |
| 6,019,156 | A | 2/2000 | Wagner et al. |
| 6,122,862 | A | 9/2000 | Hormann |
| 6,439,292 | B1 | 8/2002 | Schutte et al. |
| 6,467,128 | B1 | 10/2002 | Damani |
| 6,735,820 | B1 | 5/2004 | Teutsch |
| 6,926,061 | B2 | 8/2005 | Schulte |
| 7,252,133 | B2 * | 8/2007 | Bengtsson et al. ..... 160/265 |
| 2003/0047291 | A1 | 3/2003 | Klein |
| 2005/0115688 | A1 * | 6/2005 | Frede ..... 160/268.1 |

FOREIGN PATENT DOCUMENTS

| | | | |
|---|---|---|---|
| AT | 341 177 | B | 1/1978 |
| DE | 298 04 411 | U1 | 6/1998 |
| DE | 10 2007 037 892 | A | 9/2008 |

OTHER PUBLICATIONS

EPO International Search Report.

* cited by examiner

*Primary Examiner* — Katherine W Mitchell
*Assistant Examiner* — Jeremy Ramsey
(74) *Attorney, Agent, or Firm* — Frommer Lawrence & Haug LLP; Ronald R. Santucci

(57) ABSTRACT

A counterbalance system for a rollup door system having a drum in which the counterbalance provides a counter force acting at a distance from the center of rotation of the drum. The counter force is variable in both direction and magnitude at various angular positions of the drum.

16 Claims, 3 Drawing Sheets

ADJUSTABLE COUNTERBALANCE SYSTEM FOR ROLLER DOORS

FIELD OF THE INVENTION

The invention generally relates to roller doors configured to wind up on a drum or drum means and unwind therefrom. More specifically, the invention relates to a counterbalance system for rollup doors which provides an adjustable counter force. More particularly, the invention relates to an adjustable counterbalance system for rollup door systems in which the counter force is adjustable in magnitude and direction.

BACKGROUND OF THE INVENTION

The invention disclosed herein relates to devices that assist in the rolling and unrolling, or winding and unwinding, of flexible coverings, or increases the safe operation of such flexible coverings, for opening in a building, e.g., rollup doors to cover a doorway. The invention has application, or potential application, to the construction or building fields, e.g., rollup coverings for doorways, windows, or other openings in structures or buildings, as well as in the transportation field, e.g., ships, railcars, aircraft, commercial vehicles, or other fields in which a flexible rollup covering is desirable.

Industrial facilities, such as factories, warehouses, garages, and the like, may use rollup doors to cover doorways or other areas to separate the interior of the facility from the exterior, to separate areas within the facility in order to provide security, as well as protection from noise, debris, and unwanted climactic variations. Typical rollup door systems include a rollup door and a drum positioned above the doorway to be covered, and a drive motor or system for powering the rotation of the drum. Some door systems are capable of moving quickly between a closed position, in which the door is unwound from the drum and covers the doorway, and an open position in which the door is wound upon the drum and the doorway is uncovered.

Large rollup doors, or those which open or close quickly, are often equipped with a counterbalance system to counteract the force applied to the drum attributable to the weigh of the portion of the rollup door not wound upon the drum. Counterbalance systems may also be provided to ensure the safe operation of a flexible covering and to enable manual operation of the covering, for example, during a power interruption or drive failure.

SUMMARY OF THE INVENTION

Flexible rollup coverings encompasses all coverings that may be wound up on a drum (as discussed below), and may include coverings comprising a sheet-like panel or panels, or an articulated covering formed of rigid or flexible panels directly or indirectly connected to each other in such a way that the panels can rotate or pivot along a longitudinal edge, or otherwise move relative to each other allowing the rollup covering as a whole to conform to the shape of the drum. As discussed above, flexible rollup coverings may cover a doorway, a window, or other opening in a building or other structure, or may separate an interior space from an exterior space, or may separate interior spaces form each other. For purposes of this disclosure, all flexible rollup coverings will be referred to as doors or rollup doors, recognizing that in some instances, the disclosed rollup covering may be used to cover an opening other than a doorway.

Typical wind up drums comprise cylindrical drums, but drums having a plurality of flat sides, or a plurality of curved segments, are anticipated. All configuration will generally be referred to as drums. Regardless of the drum configuration, the drum is understood to be supported for rotation along the longitudinal axis or axis of rotation of the drum. The drum may be supported for such rotation by an integrally formed coaxial hub, tube, or axle, or the drum may be supported on a separate hub, tube or axle having a longitudinal axis common with that of the tube.

According to some embodiments of the invention, the drum is comprised of a plurality of concentric discs mounted upon a hub, tube, or axle and spaced apart along the length of the hub, tube or axle forming a virtual drum ("drum means") which performs the function of a drum as described herein.

Typical rollup door systems include a drive motor operatively attached to the drum such that the drum rotates under the power of the motor in a first direction and in a second, opposite, direction. Control of the direction of rotation and speed of rotation of the motor directly or indirectly controls the direction and speed of rotation of the drum. The motor, motor control, and operative attachment to the drum are known to the art.

In a typical rollup door system, one edge of the rollup covering or door, the top edge, or a portion of the top edge, is typically operatively fixed to the drum. The top edge of the door is generally fixed along a longitudinal line on the surface of the drum, or fixed along a portion or portions of that line, parallel to the axis of rotation of the drum such that left and right edges of the door are parallel with the ends of the drum, although other attachments schemes are possible. Powered rotation of the drum by the motor in a first direction may be provided such that the door is wound up on the drum, uncovering the opening. Powered rotation of the drum by the motor in a second, opposite, direction causes the door to unwind from the drum, closing the opening.

In winding the door up on the drum, the door is wound in successive layers, the first, innermost layer is against the drum, and successive layers are wound, each upon the previous layer. In doing so, the bottom edge of the door is raised an amount proportional to, or approximately proportional to, the circumference of the drum, for the first layer, or the previously wound layer, for all successive layers. When the door is raised to a desired position, rotation of the motor is selectively stopped, stopping the rotation of the drum.

Rotation of the drum may be selectively stopped at any point in its rotation between an extreme unwound position, at which the opening is fully covered, and an extreme open position in which the door is not covering the opening. The extreme open position may or may not correspond to a position in which the door is fully wound upon the drum. In some instances, it may be desirable to stop rotation of the drum before the door is fully wound on the drum.

When the door is fully unwound from the drum, that is the door is fully lowered to cover the opening and the lower edge of the door is in contact with a lower surface, e.g., the ground or floor, forming the bottom of the opening, and it is desired to open the door, the drum must rotate in a first direction to raise the door by winding the door up on the drum. When the lower edge of the door is no longer in contact with the lower surface, the drum is supporting the entire weight of the door. The weight of the door provides a force exerted upon the drum at a distance from the axis of rotation. Mechanical principles indicate that a force applied to a body at a distance from the body's axis of rotation creates a torque or moment applied to the body, here a drum, about the body's axis of rotation. The point at which the force is applied to the drum is the lifting point, also the lowering point, that is, the point on the drum that first comes in contact with the door when the door is wound up and the last point to contact the door when it is unwound from the drum. The lifting point is located approximately at one end of the horizontal diameter of the drum plus any included layers of rollup door on the drum, and is typically located on the side of the drum closest to the opening to be covered.

When the winding up of the door is initiated from a fully unwound position, the rotation of the drum must overcome the torque provided by the full weight of the door applied at the lifting point. This can present a significant load on the drive motor, requiring a large capacity motor to initiate the winding. As will be discussed below, the large capacity motor is primarily needed to initiate the winding, primarily in the early stages of winding.

In some instances it may be desirable, or necessary, to manually open the rollup door. As with powered winding of the door under the power of the motor, initializing the winding from the fully opened position requires overcoming the torque resulting from the weight of the unwound portion of the door acting at the lifting point. In many instances the weight of the door is sufficiently large to make manual opening under such conditional difficult, or impossible, to accomplish safely.

When winding a rollup door under power or manually, in many instances it is desirable, or necessary, to have a counterforce applied to the drum in the form of a torque to assist in the lifting of the door to wind it upon the drum. A counter force applied to the drum directly or through the drum support, e.g. the axle, may be applied as a torque to balance, or substantially balance, opposing torque attributable to the weight of the unwound door.

The magnitude of the counter force varies as the door is wound upon the drum. As discussed above, when the door is being wound up from a fully unwound position, the full weight of the door being lifted by the drum contributes to the torque about the axis of rotation. At this point, the offset distance between the axis and the load, sometimes referred to as the moment arm, is approximately half the diameter of the drum. Any layers of door material or other materials on the drum would increase the length of the moment arm. As layers of the door are wound onto the drum, the moment arm increases by approximately one thickness of the door per revolution of the drum. Concurrently, the weight of the door applied at the lifting point is decreasing as the door is wound upon the drum.

As the weight of the door suspended from the drum decreases, in many instances the torque developed as the product of the moment arm and the force (weight of the unwound door) decreases. Therefore, the torque requirements of the drive motor or system may vary during the winding up operation of the rollup door system. In many instances, the torque requirements of the drive system are greatest when the winding up process is just begun from a fully unwound condition, and the requirements are least when the door is substantially completely wound on the drum. Between the fully unwound and fully wound conditions of the door system, the torque requirements may vary in magnitude and direction, and under some conditions, may be zero or near zero.

The portion of the door wound on the drum is evenly, or substantially evenly, distributed around the circumference of the drum. The evenly distributed, or substantially evenly distributed, weight provides substantially equal but opposite torque forces about the axis of rotation. Consequently, the weight of the door wound upon the drum contributes little, if any, net torque component about the axis of drum rotation. A force component contributing to a net torque about the axis of rotation is the weight of the portion of the door not yet wound upon the drum.

As the door is wound on the drum, more of the weight of the door is transferred to the drum, and less weight is applied to the drum at the lifting point. In many cases, this leads to a reduced torque applied to the drum, even though the moment arm of the applied load (the weight of the unwound door) is increasing.

Consequently, in some applications, it may be desirable to have an adjustable counterforce, which may be applied as a torque, that varies with the torque resulting from the weight of the unwound door acting at the lifting point. The adjustable counterforce may be applied by a counterbalance device throughout all or a portion or portions of the winding of the rollup door. During a portion or portions of the winding up of the door, no counterforce may be necessary.

Similarly, upon unwinding a rollup door from a drum, the weight of the door applied through the lowering point (corresponding to the lifting point for raising the door) increases as the door is unwound. Concurrently, the moment arm decreases as the door is unwound.

When unwinding the door, a similarly variable torque condition is typically encountered. As a fully wound door is unwound, most of the weight of the door is evenly, or substantially evenly, distributed around the circumference of the drum. Any portion of the door not wound on the drum, or wound on the drum and not balanced by a similar portion of door on the opposite side of the axis, contributes to a torque tending to unwind the door from the drum. The torque tending to unwind the door from the drum is the product of the weight of the unwound portion, or unbalanced portion, of the door and the moment arm, the distance from the axis of the drum (the center of rotation of the drum) to the point of application of the load, the lowering point. As the door begins to unwind, the force component of the torque is at a minimum and the moment arm is at the maximum. As more of the door is unwound from the drum, the weight, or force applied to the drum increases, and the moment arm decreases. As the door is unwound to substantially completely cover the opening, the weight or force component approaches a maximum magnitude and the moment arm approaches a minimum, substantially corresponding to the initial condition for winding the door.

Accordingly, during the unwinding of a rollup door, the torque applied by the weight of the door increase as the door is unwound. The requirement of the motor or drive system to apply a torque to lower the door is minimal, as the torque resulting from the weight of the door tends to cause rotation of the drum in a second direction, i.e., the unwinding direction. Powered unwinding may be necessary to provide rapid unwinding of the door or to overcome frictional forces which may hamper or prevent unwinding of the door under the weight of the unwound portion of the door.

At some point during the unwinding, the drive system or motor, or some other system or components, may be required to apply a braking force to the unwinding door to control the speed at which the door is unwound. Excessive and/or uncontrolled speed in the unwinding of a rollup door presents safety issues to those who may be in the path or vicinity of the unwinding door. Uncontrolled speed also presents an opportunity for damage to the door system in the event the door contacts an immobile object at a high speed. The braking force can be applied as a torque to the drum directly, or indirectly, i.e., to the axle, in a direction opposite to the unwinding direction. Other locations for applying a speed reducing torque or braking force may be available. In many instances, it is desirable to apply a continuous braking force during at least a portion of the unwinding to slow the unwinding of the door in a controlled fashion throughout the unwinding of the door. In many instances, a continuously variable braking force is desirable to continuously slow the unwinding of the door in a controlled fashion throughout all or a portion of the unwinding of the door.

One way to provide the needed braking force is through a counterbalance system. The counterbalance may provide a force to be applied at a distance from the axis of rotation of the drum to produce a torque opposed to the torque formed by the weight of the door acting through the lowering point. The counterbalance system may apply the force directly to the drum, or indirectly, as through the axle or some other suitable component.

Counterbalance devices according to various embodiments of the invention may provide a force to be applied to the drum, either directly or indirectly. A force applied according to various embodiments of the invention may be applied through the axis of rotation of the drum or offset from the axis of rotation of the drum. According to some embodiments of the invention, the force applied by the counterbalance system is offset from the axis of rotation in a first radial direction. The force applied by the counterbalance system is offset from the axis of rotation in a second radial direction, opposite to, or substantially opposite to, the first radial direction.

According to some embodiments of the invention, the force applied by the counterbalance device may be applied through the longitudinal axis of the drum, sometimes referred to as the center of rotation of the drum, perpendicular to, or nearly perpendicular to, the axis or center of rotation. With a force applied through the axis of rotation, there is no radial offset between the force applied and the axis of rotation. Accordingly, the force applied through the axis provides no torque, or moment, about the axis. Such forces applied through the center of rotation do not urge rotation of the drum about the center of rotation.

According to some embodiments of the invention, the force applied by the counterbalance device may be applied offset a first distance from the longitudinal axis, or axis of rotation, of the drum. The first offset distance, measured from the axis of rotation to the point of application of the first force, provides a radial offset, or a first moment arm. Established mechanical principles indicate that a force applied to an object at a distance from an axis of the object creates a tendency for the object to rotate about that axis. The magnitude of the rotational force, or torque, is the product of the directed distance between the point of application of the force and the axis of rotation and the magnitude of the force. Accordingly, a force applied through a point offset from the axis of the drum creates a torque, or moment, about the axis of the drum. Torque forces applied about the drum's center of rotation urge rotation of the drum about the center of rotation or axis and will result in rotation of the drum absent an opposing torque or moment. Opposing torques are summed to determine a net torque applied to the drum. The net torque applied to the drum directly influences in the magnitude and direction of rotation of the drum.

According to some embodiments of the invention, the counterbalance system is adjustable or variable in both magnitude of the force applied and the location on the drum at which the force is applied. In some embodiments, the variation in the magnitude of the counterbalance force applied and the location of the application of the counterbalance force to the drum varies during a cycle of winding up the door or unwinding the door. For example the force applied to the drum at the initiation of winding up may be of a first magnitude and applied at a first point on the drum, directly or indirectly. As the door is wound up on the drum, the magnitude of the force applied varies, the point of application of the force varies, or both the magnitude and point of application vary. In some embodiments of the invention, the variation in the point of application changes the direction of the drum rotation According to some embodiments of the invention, the force applied is continuously variable in magnitude or application point, or both, during the winding up or unwinding of the door. The magnitude, the point of application, or both, vary discretely during the winding up or unwinding of the door.

According to some embodiments of the invention, the variable force is applied by a tension resisting biasing devices. The tension resistant biasing device provides a force the magnitude of which is variable with the magnitude of the tension force applied thereto, between a minimum tension force and a maximum tension force. In some embodiments, the magnitude of the force provided by the tension resistant biasing device is proportional to a deformation of the biasing device. Such biasing devices may comprise, for example, springs, cylinders acting upon, or acted upon by, a working fluid, such as hydraulic or pneumatic cylinders, magnetic coils, resilient members or structures, for example rubber cables, weights or weight systems, or other suitable mechanical, electronic, or electromechanical devices as known to the art.

According to some embodiments of the invention, the torque force applied by the counterbalance system to the drum urges rotation of the drum in a first, or winding up, direction through at least a portion of the rotation of the drum.

According to some embodiments of the invention, the torque force applied by the counterbalance system to the drum urges rotation of the drum in a second direction through at least a portion of the rotation of the drum. The second direction is opposite that of the first direction.

The force applied by the counterbalance device may be applied through the axis of rotation of the drum. Applied as such, there is no radial offset between the force applied and the axis of rotation. As torque is the product of a force and the directed distance between the point of application of the force and an axis, a force applied through the axis does not result in a torque. A force applied by the counterbalance system through the axis of rotation of the drum does not, therefore, urge rotation of the drum about its axis of rotation in either a first or second direction.

According to some embodiments of the invention, the tension resisting biasing device, or biasing device, is fixed at a first end. In others, rotation about the first end is allowed.

The second end of the biasing device may be operatively attached to a second end of a flexible, elongate structure or construct suitable for transmission of a tension force without, or substantially without, elongation, and resistant to failure or rupture. In some embodiments, the flexible elongate structure is a band-like construct, i.e., a belt, a rope, a cable, a wire, belt-like structure, or a series of belts, ropes, cables, wires or belt-like structures ("belt means"). For ease of description, "belt means" is used throughout this disclosure and it used with the broadest interpretation to encompass ropes, cables and wires. Exemplary materials for the belt according to the invention include natural or manmade fibers, metallic or non-metallic strands or fibers, leather, or other suitable elongation-resistant materials with appropriate load-carrying abilities.

The operative attachment of the belt to the biasing device prevents separation of the two elements while allowing relative rotation between the belt and biasing device.

The band or belt-like structure may be integrally formed with the biasing device, that is, the band or belt-like structure is fabricate of the same material as the biasing device during an earlier manufacturing step, a later manufacturing step, or the same manufacturing step. In another embodiment, the band or belt is separately fabricated and joined with the biasing device during a manufacturing step.

According to some embodiments of the invention, a first end of the belt may be fixed to the drum directly or indirectly in a manner to allow winding of the belt upon the drum, or structure attached thereto, i.e., an integrally formed coaxial hub, tube, or axle or separately formed coaxial hub, tube, or axle fixed to the drum.

The fixation of the belt to the drum is such that there is controlled or limited rotation of the drum with respect to the belt for at least a portion of the winding up or unwinding cycle. For a period, or periods, of driven rotation of the drum, the belt is not wound upon the drum as the drum rotates. The drum rotates separately from the belt, or slips with respect to the belt. At the end of the prescribed period of slip, the belt is again taken up on the drum.

The first end of the belt may be attached to the drum such that, when the rollup door is at a selected position between a fully closed position and a fully opened position, the biasing device applies a force to the drum through the center of rotation of the drum. According to some embodiments of the invention, the attachment point of the belt to the drum is adjustable angularly. That is, in some embodiments, the drum is rotated about its axis until an appropriate angular position is reached to attach the first end of the belt to the drum. In some instances, the drum is rotated with the rollup door wound in layers upon the circumference of the drum until the appropriate position for attachment is reached. When the biasing force of the biasing device is applied through the center of rotation of the drum, the biasing force is at its minimum magnitude. That is, in some embodiments, when the doorway is partially covered by the rollup door, the biasing device provides the minimum tensile force to the drum, and that force is applied through the center of rotation of the drum.

The position of the bottom edge of the door, corresponding to a desired coverage of the doorway by the rollup door, is used to establish the angular position of the drum corresponding to the appropriate position for attachment of the belt to the drum. In some instances according to this invention, when approximately 30% of the doorway is covered by the rollup door, that is, the doorway is approximately 70% open or uncovered by the rollup door, the biasing force supplied by the biasing device is applied through the axis of rotation of the drum, and the magnitude of the force applied is a minimum. The corresponding angular position of the drum is sometimes referred to as the zero torque position or the neutral position.

The rotation of the drum in a first direction from the neutral position causes the belt to wind upon the drum in a first direction. Similarly, rotation of the drum in a second direction from the neutral position causes the belt to wind up on the drum in a second direction. The direction of drum rotation from the neutral position determines the direction of wind-up of the belt on the drum. The direction of wind-up determines the direction of the offset from the axis of rotation, and therefore determines the direction of the applied biasing force. As the belt is wound about the drum, successive layers of the belt are wound on top of each other. As the biasing device applies the biasing force through the belt, successive layers of the belt wound upon the drum move the point of force application further away from the axis of rotation of the drum. Accordingly, the moment arm increases as the number of wound up layers increases.

The rotation of the drum in a first direction from the neutral position causes the door to further wind up on the drum and causes the belt to wind up on the same side of the drum axis as the free, lower end of the rollup door. As the biasing force is applied through the belt, and because rotation in a first direction winds the belt about the drum on the same side of the axis as the free end of the door, the biasing force applied at a distance from the axis of rotation, tend to cause the drum to unwind the rollup door. That is, the biasing force tends to return the door system to it neutral position.

Correspondingly, rotation of the drum in a second direction from the neutral position causes the door to further unwind from the drum to more completely cover the doorway. Second direction rotation of the drum causes the belt to wind up on the drum on the side opposite the free, lower end of the door. As the biasing force is applied through the belt, and because rotation in a second direction winds the belt about the drum on the side of the axis opposite the free end of the door, the biasing force applied at a distance from the axis of rotation, tends to cause the drum to wind-up the rollup door. That is, the biasing force tends to return the door system to it neutral position.

Therefore, a rotation of the drum from the neutral position in either a first or second direction causes a deflection in the biasing device of the counterbalance system. The deflection of the biasing device gives yield to a biasing force applied by the counterbalance system to the drum at a distance from the axis of drum rotation. The biasing force acting at a distance from the drum's axis creates a torque in a direction counter to the drum rotation.

A plurality of counterbalancing devices may be used on a single rollup door. For example, in some instances, one counterbalance system is located at each side of the doorway. Each belt is operatively attached to the corresponding end of the drum such that each belt winds about the drum, and the counterbalance force is applied at a distance from the axis of rotation of the drum, that is, the force produces a torque about the axis of rotation of the drum. In some embodiments, the belt winds upon the drum in the same direction such that each counterbalancing device provides a force to act on the drum inducing a rotation in the same direction, that is, each applied force produces a torque in the same direction.

In some embodiments of the invention using a plurality of biasing devices, at least one of the plurality of belts winds up on the door such that a tension force applied to the belt by the biasing device will cause a torque in a first direction, for example, in the direction corresponding to winding the door up on the drum. At least one other of the plurality of belts is wound in a direction opposite to the first belt, for example in the direction corresponding to unwinding the door from the drum.

Each belt of the plurality of biasing devices is attached to the drum such that each biasing device is in the neutral position at the same angular position of the drum. In other embodiments of the invention, each of the plurality of biasing devices are in the neutral position at a different angular positions of the drum.

BRIEF DESCRIPTION OF THE DRAWINGS

The following description, given by way of example and not intended to limit the invention to the disclosed details, is made in conjunction with the accompanying drawings, in which like references denote like or similar elements and parts, and in which.

DETAILED DESCRIPTION OF PREFERRED EMBODIMENTS

Embodiments of the invention are described below with reference to the accompanying drawings which depict embodiments of rollup door counterbalance system. However, it is to be understood that application of the invention encompasses other uses for the invention in applications involving rollup coverings. Also, the invention is not limited to the depicted embodiments and the details thereof, which are provided for purposes of illustration and not limitation.

Rollup door counterbalance systems according to embodiments of the invention provide a counterbalance force that is variable in both magnitude and point of application. The specific magnitude and application point of a counterbalance force which the system is to provide may depend upon, e.g., the particular application, door construction and/or size, or application of the rollup system.

Figure 1B:
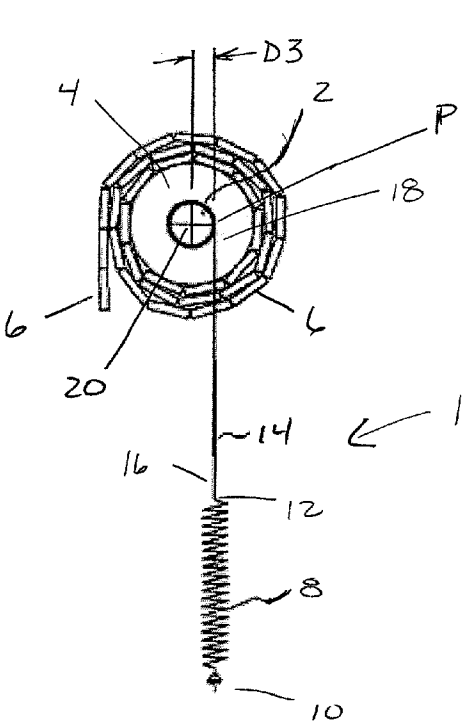
Fig 1b PRIOR ART
FIG. 1*b* is an end view of a conventional counterbalance system with the door in a wound-up position.
Figure 1A:
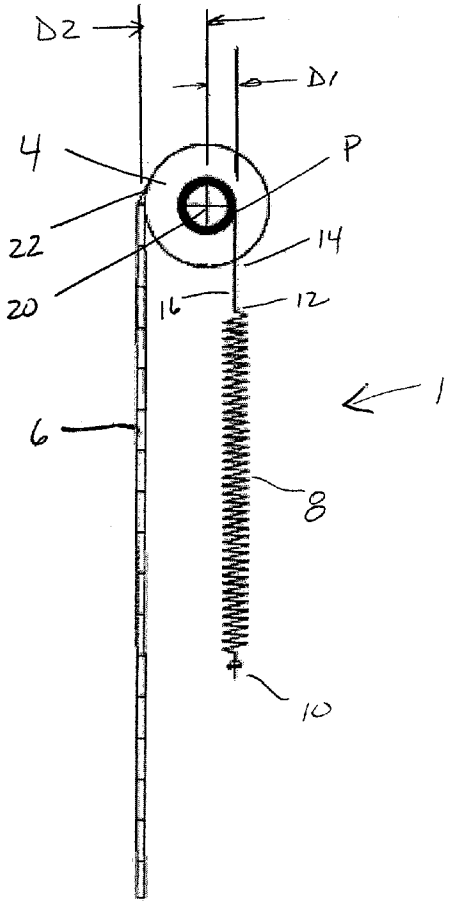
Fig 1a PRIOR ART
FIG. 1*a* is an end view of a conventional counterbalance system with the door in an unwound position.

Referring to FIGS. 1*a* and 1*b*, a conventional counterbalance system 1 is depicted operatively connected to the hub, tube, or axle 2 which is integrally formed with, or fixed to, a drum 4 upon which a rollup door 6 is affixed. Tension resistant biasing device 8 is fixed against translational movement at first end 10. Band or belt or belt-like structure 14 extends from a second end 12 of the biasing device 8. A second end extends to and is wrapped around or wound up on the hub 2 and attached thereto.

FIG. 1*a* illustrates a conventional door 6 unwound from the drum 4 to cover a doorway. FIG. 1*b* illustrates the same door 6 wound up such that a doorway is not covered by the door 6.

As illustrated in FIG. 1*a*, biasing device 8 is linearly displaced against its resilient force, thereby producing a force directed opposite the direction of elongation, i.e., downward in the illustration. The opposing force produced by resilient member 8 is applied to the hub at point P offset from the center of the drum's axis of rotation 20 a distance D1. The product of the directed distance D1 from the axis of rotation 20 the point of application of the force produces a clockwise moment, or torque, about the center of rotation.

Similarly, a downward force caused by the weight of the door 6 fixed to drum 4 at point 22 produces a moment about the axis of rotation 20, urging a counter-clockwise rotation of the drum 4. The magnitude of the moment resulting from the weight of the door is the product of the directed distance D2 from the axis of rotation to the point of application 22 and the weight of the unwound portion of the door 6. As illustrated in FIG. 1*a*, the force would be substantially the total weight of the door 6.

FIG. 1*b* illustrates the door 6 of FIG. 1*a* wound up on the drum 4. Belt 14 is unwound from the drum 4 as the door 6 winds up on the drum in response to a clockwise rotation of the drum 4, as in FIG. 1*b*. Biasing device 8 is linearly displaced a distance against its resilient force, thereby producing a force directed opposite the direction of elongation, i.e., downward in the illustration. As discussed above, the biasing force of biasing device 8, offset from the axis of rotation 20 by distance D3, creates a clockwise directed torque about the axis of rotation of the drum 4. As the door 6 is evenly wound up on the drum 4 the weight of the door 6 does not create a net torque, and no rotation about the axis 20 of the drum 4 due to the weight of the door 6 is produced. However, the conventional biasing system 1 produces a torque as discussed above, tending to cause clockwise rotation of the drum and cause the door to further roll up on the drum is not countered. This is sometimes known as an over-balanced condition when the biasing device provides a torque in excess of the weight of the door acting against the counterbalance. In many cases, a brake or door tensioning device is needed to offset the over-balanced door system.

Figure 2C:
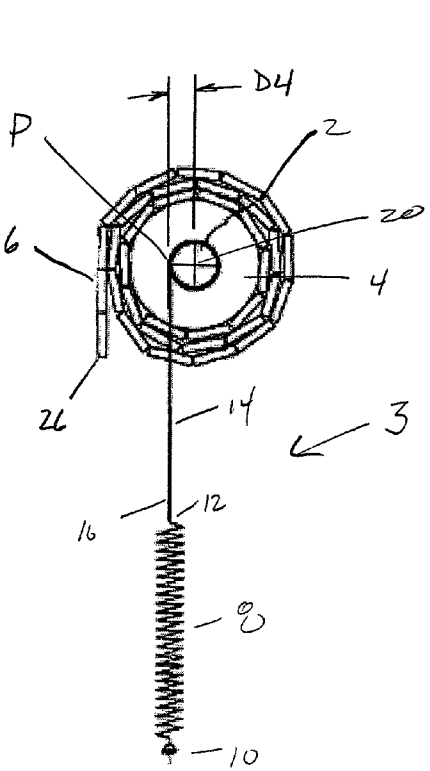
FIG. 2*c* is an end view of a rollup door counterbalance system according to the invention from a position similar to FIG. 1*b*.
Figure 2B:
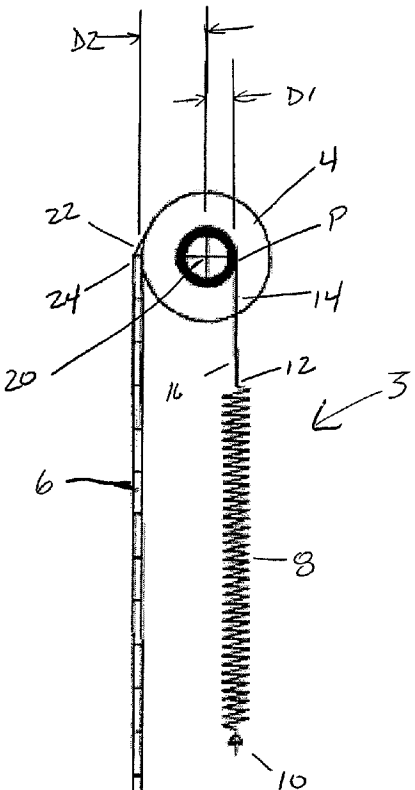
FIG. 2*b* is an end view of a rollup door counterbalance system according to the invention from a position similar to FIG. 1*a;*
Figure 2A:
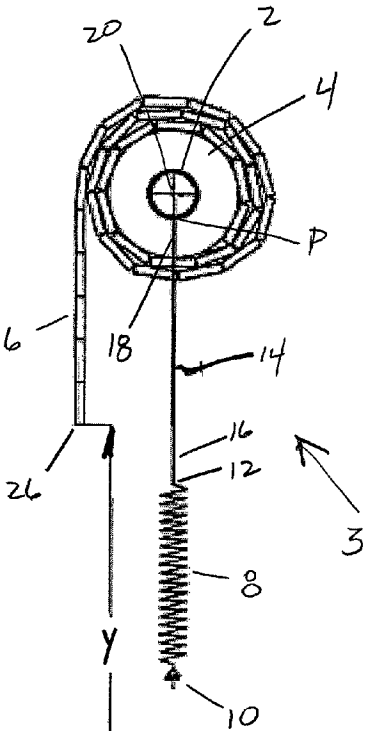
FIG. 2*a* is an end view of a rollup door counterbalance system according to the invention with the doorway partially covered.

As illustrated in FIGS. 2*a*-2*c*, according to some embodiments of the invention, the counterbalance system of the present invention includes a biasing device 8 fixed at a first end portion 10 against displacement. Second end portion 12 of biasing device 8 includes a band or belt or belt-like structure 14 integrally formed with or operatively attached to second end portion 12 of the biasing device 8. The operative attachment resists separation or linear displacement between the second end portion 12 of biasing device 8 and the second end portion 16 of the band or belt 14.

The biasing device 8 of the present invention is illustrated as a spring 8 for ease of description and illustration. As one of ordinary skill in the art may recognize, the biasing device 8 may comprise, for example, springs, cylinders acting upon, or acted upon by, a working fluid, such as hydraulic or pneumatic cylinders, magnetic coils, resilient members or structures, for example rubber cables, weights or weight systems, or other suitable mechanical, electronic, or electromechanical devices. Suitable devices provide a constant or variable resistant force against elongation or linear displacement. When displaced or elongated linearly, the device provides a resistive force. In some cases, as with some springs, the resistive force varies with the displacement of the device. Other devices produce a consistent resistive force regardless of the amount of displacement. Either type of device, linearly variable load or constant load, may be suitable for certain embodiments of this invention.

In some embodiments, the attachment of door 6 to the drum 4 is radially adjustably, i.e., the radial position of the drum at which the top edge 24 of the door 6 is attached to the drum 4 can be radially altered. For example, the attachment point 22 can radially displace along the circumference of the drum 4 to adjust the position of the bottom edge 26 of the door 6 to a desired position at a particular radial position of the drum 4.

FIG. 2*a* illustrates a rollup door system comprising an adjustable counterbalance system 3 according to one embodiment of the invention. The claimed counterbalance system is adjustable, as will become apparent below, because the counterbalance force provided is variable as far as magnitude and/or point of application, and may provide a torque which varies in direction as well as magnitude.

As depicted, band 14 is attached to drum 4, or hub 2 which is fixed to the drum 4, through the axis of rotation 20 of the drum 4 such that there is no directed offset between the center of rotation 20 of the drum and the point through which the load is applied, P. With no offset, or substantially no offset, any force the biasing device 8 applies to the drum 4 produces no, or substantially no, torque and has no, or substantially no, effect on the rotation of the drum 4. This position is sometimes referred to as the neutral position. In the neutral position as shown in FIG. 2*a*, the biasing device 8 provides a force to the drum 4 or axle 6, but does not provide any torque to the drum 4, and no rotation is urged by the biasing device 8.

According to some embodiments of the invention, the attachment of the top edge of the door 24 to the drum 4 is adjusted such that the bottom or free end 26 of the door 6 can be positioned at a prescribed distance Y from the bottom of the doorway when the door system is in a neutral position (FIG. 2*a*). Distance Y can be set such that approximately 30% percent of the doorway height is covered and 70% of the total vertical doorway height is open, that is Y is approximately 70% of the doorway height. According to other embodiments, the distribution of open/covered percentages can be other than 30/70, for instance 25/75, 35/65. or 50/50 may be desirable under certain circumstances or for some applications.

From the neutral position of FIG. 2*a*, any rotation of the rollup door system, as in a powered rotation driven by a drive system (28 in FIG. 3), will cause the band 14 to wind up on the drum 4. For example, if from the neutral position of FIG. 2*a* the drum is rotated in a counterclockwise (as shown in the figures) direction, the door 6 would unwind from the drum 4 an amount proportional to the rotation of the drum. First end portion 18 of band or belt 14 would travel in a counterclockwise direction (as shown) and begin to wrap upon the hub 2. The amount of belt wound upon the hub 2 would be proportional to the rotation of the drum 4. This is illustrated in FIG. 2*b*.

Alternately, if, for example, the drum 4 is rotated in a clockwise direction, the door 6 would further wind up on the drum 4 and first end portion 18 of belt 14 would wind up on the hub in a clockwise direction (as shown in the figures) an amount proportional to the rotation of the drum 4. This is illustrated in FIG. 2*c*.

Accordingly, a counterclockwise rotation of drum 4 from the neutral position of FIG. 2*a* results in the first end portion 18 of belt 14 winding up on the right side (as shown) of the drum 4, i.e., in a counterclockwise direction. Similarly, a clockwise rotation of the drum 4 results in the first end portion 18 of belt 14 winding up on the left side of the hub 4, i.e., in a clockwise direction.

In FIG. 2*b* the bottom or free edge 26 of the door has been lowered from position Y of FIG. 2*a* to a position in which a doorway is closed or covered completely or substantially completely. Drum 4 is supporting the entire weight of the door 6 from attachment point 22, approximately at the left end of a horizontal, or nearly horizontal, diameter.

As the door 6 unwound from the drum 4 from the neutral position of FIG. 2*a* according to the invention, band 14 was wound up on the drum in the same direction as the door 6 but on the opposite side of the drum from that of the unwinding door 6. As the band 14 is wound up on the drum 4, the second end 12 of the biasing device 8 is extending linearly toward the drum 4, stretching as the band 14 is taken up on the drum 4 or hub 2. As the biasing device 8 extends, an opposing or counter force is exerted by the biasing device 8. The counter force provided may be a constant force throughout the elongation of the device, or the force may vary with the amount of elongation of the biasing device 8.

As can be seen in FIG. 2*b*, when rotating in a counterclockwise direction from the neutral position of FIG. 2*a*, the band 14 winds up on the drum 4 or hub 2 on the side opposite the door 6. As such, the point of application P of the force exerted by the biasing device 8 is on the side of the drum axis of rotation 20 opposite the door 6. The biasing device provides a counter force applied at an offset distance D1 from the axis 20 of the drum 4, thereby creating a moment or torque about the axis 20. The direction of the torque produced by the biasing device 8 at distance D1 urges a clockwise rotation to the drum 4. In some embodiments of the invention, the torque provided by the counterbalance system 1 is similar in magnitude, but opposite in direction, to the torque provided by the force attributable to the weight of the door.

FIG. 2*c* illustrates a rotation of the drum from the position depicted in FIG. 2*a* in an opposite direction than that in FIG. 2*b*, that is, in a clockwise direction. The clockwise rotation causes the door to more fully wind up on the drum, leaving a greater portion of the doorway height uncovered. As the drum 4 rotates, as under power from the drive unit (28 in FIG. 3), the band 14 winds about the drum in the same direction as the door is wound on the drum. From the position illustrated in FIG. 2*a*, the band 14 winds up left side of the hub 2, that is, on the same side of the drum 4 as the door 6. The second end 12 of biasing device 8 is extended from the position of FIG. 2*a* a distance towards the drum. In extending, biasing device 8 provides a counter force applied at a distance D4 from the drum's axis of rotation 20.

As can bee seen in FIGS. 2*a*-2*c*, the adjustable counterbalance system 3 according to the invention, provides a counterforce through the biasing device 8 and the band 14 to the drum 4 that is variable or adjustable in both magnitude and direction. In FIG. 2*b*, the counterforce is provided on the right side of the axis 20 (as illustrated) to impart a clockwise torque on the drum 4. The magnitude of the force is variable in two regards. As the magnitude of a torque is the product of the directed distance from the axis of rotation 20 to the point of application P of the force and the magnitude of the force, in the present invention both the point of application P and the magnitude of the force applied vary. According to some embodiments, as the biasing device 8 extends in response to the band 14 winding upon the drum 4, the counter force exerted by biasing device 8 increases. In some embodiments, the counter force remains constant as the band is wound upon the hub 2 affixed to the drum 4. As the band 14 is wound upon the drum 4, each layer of band lies atop the previous layer or layers of band. Thus, the offset distance increases as each successive layer of band 14 displaces the point of application P of the load further from the axis of rotation 20. According to some embodiments of the invention, the magnitude of the counter force increase as both the offset distance increases and the magnitude of the force applied increases.

Figure 3:
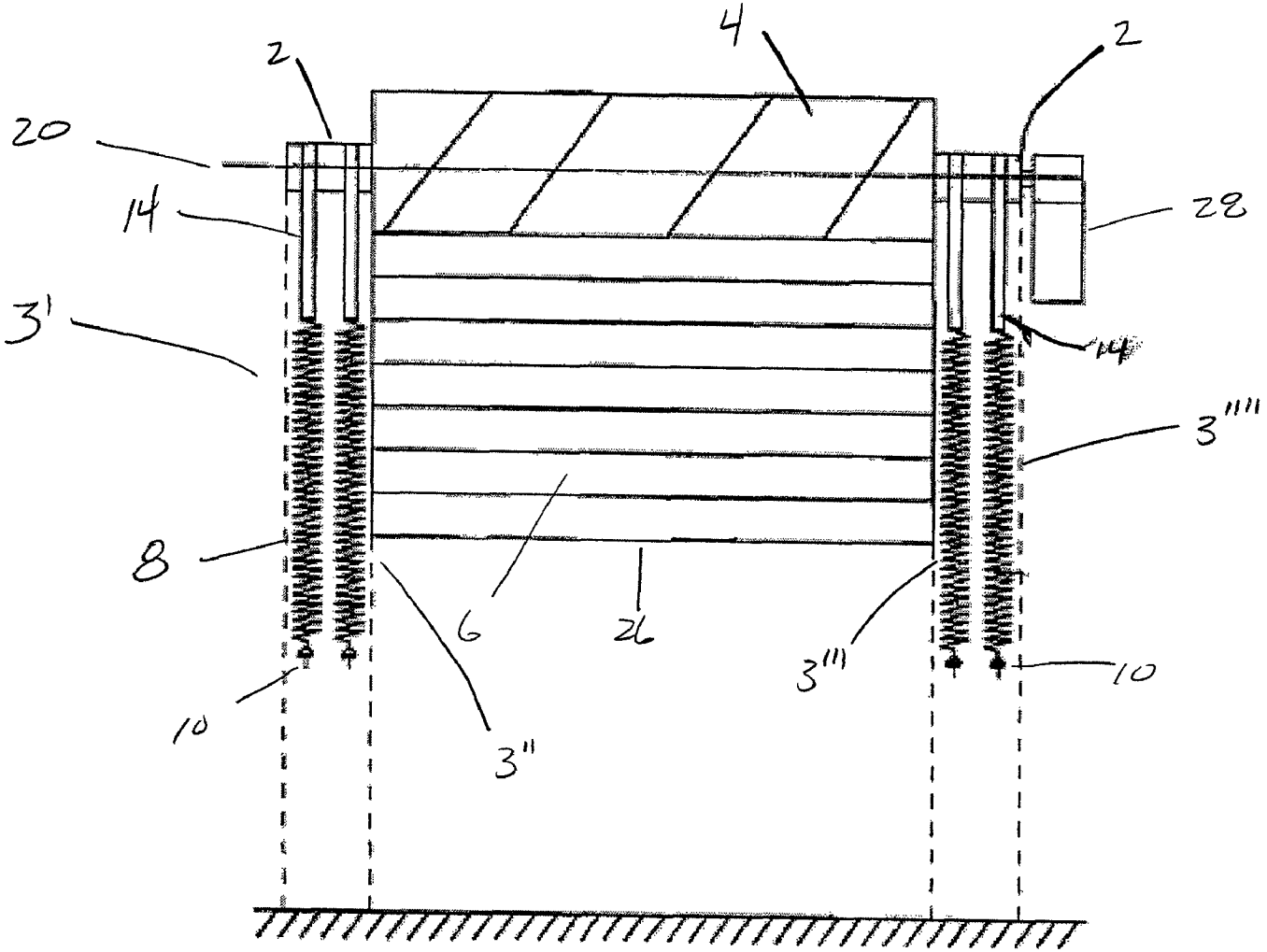
FIG. 3 is a front view of a rollup door in a partially closed position similar to FIG. 2*a*, with a counterbalance system according to the invention, as viewed from one side of the doorway.

FIG. 3 illustrates an embodiment of the present invention in which a plurality of adjustable counterbalance systems can be used on one rollup door system. Adjustable counterbalance systems 3' and 3" are provided on one side of the door 6 (the left side as illustrated in FIG. 3) with the associated belt 14 attached to the drum 4 through hub 2. Adjustable counterbalance systems 3"" and 3"" are provided on the other side of the door (the left side as illustrated) with the associated belt 14 attached to the drum 4 through hub 2. As illustrated, each of the belt 14 is wound on the near side of the hub 2 and over the top of the hub, that is, in a clockwise direction as viewed from the drive motor 28 end. It is anticipated that in applications using a plurality of adjustable counterbalance systems, it may be desirable for the belt 14 of at least one counterbalance system to be wound in a direction opposite the other belt.

The plurality of adjustable counterbalance systems 3'-3"" used on a door system need not be symmetrically distributed on the right and left sides of the door 6 as illustrated on FIG. 3. In some applications, it may be desirable to provide one side of the door 6 with a greater number of counterbalance systems that the other.

FIG. 3 also illustrates substantially identical biasing devices 8 in each counterbalance system. In some applications, it will be found desirable to provide various biasing device configurations to achieve a desired performance from the counterbalance system. Biasing devices 8 may have different lengths or diameters, or may be of different types, designs, or styles, and may first ends 10 fixed at various positions relative to the drum. For simplicity of illustration, the myriad possible combinations of devices and configurations has been omitted.

Various embodiments of the biasing device 8 may be provided that vary the counter force in response to factors other than displacement of the biasing device, such as wind-up or unwind speed, or predicted or anticipated effective weight of the unwound door based on the drum angular position.

Embodiments of the disclosed invention have been described and illustrated in an exemplary and non-limiting sense, and are not to be limited to the precise details of methodology or construction set forth above. For example, variations and modifications of the tension resistant biasing device and the attachment of the device to the drum will be evident to those skilled in the relevant arts from the disclosure herein and are should be encompassed by the disclosure.

I claim:

1. An adjustable counterbalance system for use with a flexible rollup covering or door system which comprises a drum means having and supported by a generally horizontal hub; a flexible rollup covering or door having a top edge, a bottom edge, and opposing side edges, the top edge affixed to the drum means, and the bottom edge adapted for vertical cyclic movement between an unwound position and a wound-up position; and at least one adjustable counterbalance system comprising:

a tension resisting biasing device extendible against a tension force, the biasing device having a first end fixed to resist linear displacement, and a second end;

a belt means having a first end and a second end, wherein the first end of the belt means is fixed to a portion of the hub or drum means for winding upon a portion of the hub or drum means in a first direction or a second direction, and the second end of the belt means is coupled to the second end of the biasing device, wherein the belt means is operatively attached to the portion of the hub or drum means such that rotation of the hub or drum means in a first direction causes the belt means to wind about in a first direction and rotation of the hub or drum mean in a second direction causes the belt means to wind about in a second direction, and the adjustable counterbalance system applies a first force to the drum means through a first point, the first force directed substantially perpendicular to a longitudinal axis of the drum means, the first point being a center of rotation of the drum means, when the door is in first position, a second force applied through a second point on a diameter of the drum means when the door is at least partially unwound from the first position and a third force through a third point on a diameter of the drum means when the door is at least partially wound up from the first position.

2. The adjustable counterbalance system according to claim 1 wherein the second force is applied through a first end of a substantially horizontal diameter of the hub.

3. The adjustable counterbalance system according to claim 1 wherein the third force is applied through a second end of a substantially horizontal diameter of the hub.

4. The adjustable counterbalance system according to claim 1 wherein a point of application of the second force and the third force vary radially from the center of the hub throughout the winding up and the unwinding of the rollup covering or door.

5. The adjustable counterbalance system according to claim 1 wherein the tension resisting biasing device provides a constant force against linear deflection.

6. The adjustable counterbalance system according to claim 1 wherein the tension resisting biasing device provides a variable force against linear deflection.

7. The adjustable counterbalance system according to claim 1 wherein the tension resisting biasing device provides a force through a first point, a second point and a third point through a winding up of the covering or door from an unwound position.

8. The adjustable counterbalance system according to claim 1 wherein the tension resisting biasing device provides a force through a first point, a second point and a third point through an unwinding of the covering or door from a wound up position.

9. The adjustable counterbalance system according to claim 1 wherein the covering or door means is approximately 70% wound up on the drum means when the biasing device applies the force through the center of rotation of the drum means.

10. The adjustable counterbalance system according to claim 8 wherein the force applied to the drum means by the tension resisting biasing device through the second point produces a torque in a first direction about the center of rotation of the drum means.

11. The adjustable counterbalance system according to claim 8 wherein the force applied to the drum means by the tension resisting biasing device through the third point produces a torque in a second direction about the center of rotation of the drum means.

12. The adjustable counterbalance system according to claim 8 wherein the force applied to the drum means by the tension resisting biasing device through the first point produces substantially no torque about the center of rotation of the drum means.

13. The adjustable counterbalance system according to claim 1 wherein at least one adjustable counterbalance system is located on a first side of the of the hub or drum means and another adjustable counterbalance systems is located on a second side of the hub or drum means, and the belt means of each adjustable counterbalance system is wound upon the respective end of the hub or drum means.

14. The adjustable counterbalance system according to claim 13 wherein the belt means of the counterbalance systems are configured to wind upon the hub or drum means in the same direction.

15. The adjustable counterbalance system according to claim 13 wherein the belt means of one of the adjustable counterbalance systems is configured to wind upon the hub or drum in a first direction and the belt means of the other adjustable counterbalance systems is configured to wind upon the hub or drum means in a second direction.

16. The adjustable counterbalance system according to claim 1 wherein at least one adjustable counterbalance system is located on a first side of the drum means and at least two adjustable counterbalance systems are located on a second side of the drum means, and the belt means of each adjustable counterbalance system is wound upon the respective end of the drum means or hub.

* * * * *